United States Patent [19]

Chiu

[11] Patent Number: 5,054,851

[45] Date of Patent: Oct. 8, 1991

[54] SEAT ATTACHMENT DEVICE FOR INFANT WALK SUPPORT

[75] Inventor: Hsiu-Hui Chiu, Tainan Hsien, Taiwan

[73] Assignee: Sunshon Molding Co., Ltd., Tainan Hsien, Taiwan

[21] Appl. No.: 587,748

[22] Filed: Sep. 25, 1990

[51] Int. Cl.[5] ..... A47D 13/04

[52] U.S. Cl. ..... 297/136; 297/5

[58] Field of Search ..... 297/5, 136, 441, 440; 272/70.3; 280/87.02

[56] References Cited

U.S. PATENT DOCUMENTS 4,095,843 6/1978 Hirsch ..... 297/136
4,171,847 10/1979 Tukui ..... 297/136 X
4,359,242 11/1982 Gerken et al. ..... 257/5
4,364,576 12/1982 Kassai ..... 297/136 X
4,433,869 2/1984 Payne, Jr. et al. ..... 297/136 X
4,770,410 9/1988 Brown ..... 297/5
4,822,030 4/1989 Cone ..... 297/5 X

*Primary Examiner*—Peter A. Aschenbrenner
*Attorney, Agent, or Firm*—Morton J. Rosenberg; David I. Klein

[57] ABSTRACT

An infant seat is releasably suspended from an opening of a table of an infant walk support with a securing devices. Each securing device is formed by a bent plate of U section for fitting into perforations surrounding the opening and having spaced-apart legs. One of the legs is secured to the infant seat and the other of the legs is formed with a transverse flange for engaging an edge of the perforation in the table.

1 Claim, 3 Drawing Sheets

SEAT ATTACHMENT DEVICE FOR INFANT WALK SUPPORT

BACKGROUND OF THE INVENTION

This invention relates in general to infant supports and more particularly to a releasable seat support arrangement for an infant walk support.

Infant supports have a chair or seat suspended from the center of the table and are usually provided with a leg adjustment apparatus to permit the table to be raised or lowered as suits the baby's mother. Raising the table generally enables the mother to more conveniently feed the child and this position is commonly known as the feeding position. Lowering the table places the child closer to the floor during play periods, when child may be unsupervised to minimize the possibility of injury if the child should crawl over an edge of the table. The latter position of the table is commonly known as the play position.

As shown in FIG. 4, a seat or chair 2 is suspended in an opening formed in a table 3. The seat 2 has a back 1 stuffed with sponge 11 and an upraised reinforcement plate 12. A nut 14 is disposed in the back 1 to receive the upper portion 42 of a screw shank 4 and further secured to the reinforcement plate 12 by means of a rivet 13. Said screw shank 4 extends through openings formed in the bottom of the back 1, the seat 2 and the perimeter 31 of the table 3. A wing nut 41 is threaded tightly on the lower portion 43 of the screw shank 4 from the side opposite to the nut 14 so that the back 1 is securely mounted on the perimeter 31 and margin of the seat 2 is firmly sandwiched between bottom of the back 1 and perimeter 31 of the table 3. As may be appreciate this chair support arrangement is relatively difficult to assemble the chair to or disassemble the chair from the table for cleaning.

SUMMARY OF THE INVENTION

It is a primary object of the present invention to provide an improved, economical and releasable seat attachment device for an infant walk support.

The present invention proposes the use of a seat attachment device for an infant walk support which comprises an infant walk support frame having a table formed with an opening and a plurality of perforations surrounding the the opening, an infant seat adapted to be suspended in the opening, an back mounted on the infant seat and adapted to be reated on the table, a reinforcement plate attached to a rear side wall of the back and a plurality of securing pieces adapted to be fitted into corresponding perforations, each having a first leg attaching to the reinforcement plate and a second leg spaced from the first leg and formed with a free end extending outwardly for pressing with a finger tip to move the second leg inwardly towards the first leg and a radially extending stop means for engaging an edge of the perforation in the table.

DETAILED DESCRIPTION OF THE PREFERRED EMBODIMENT

Figures 1A, 1B:
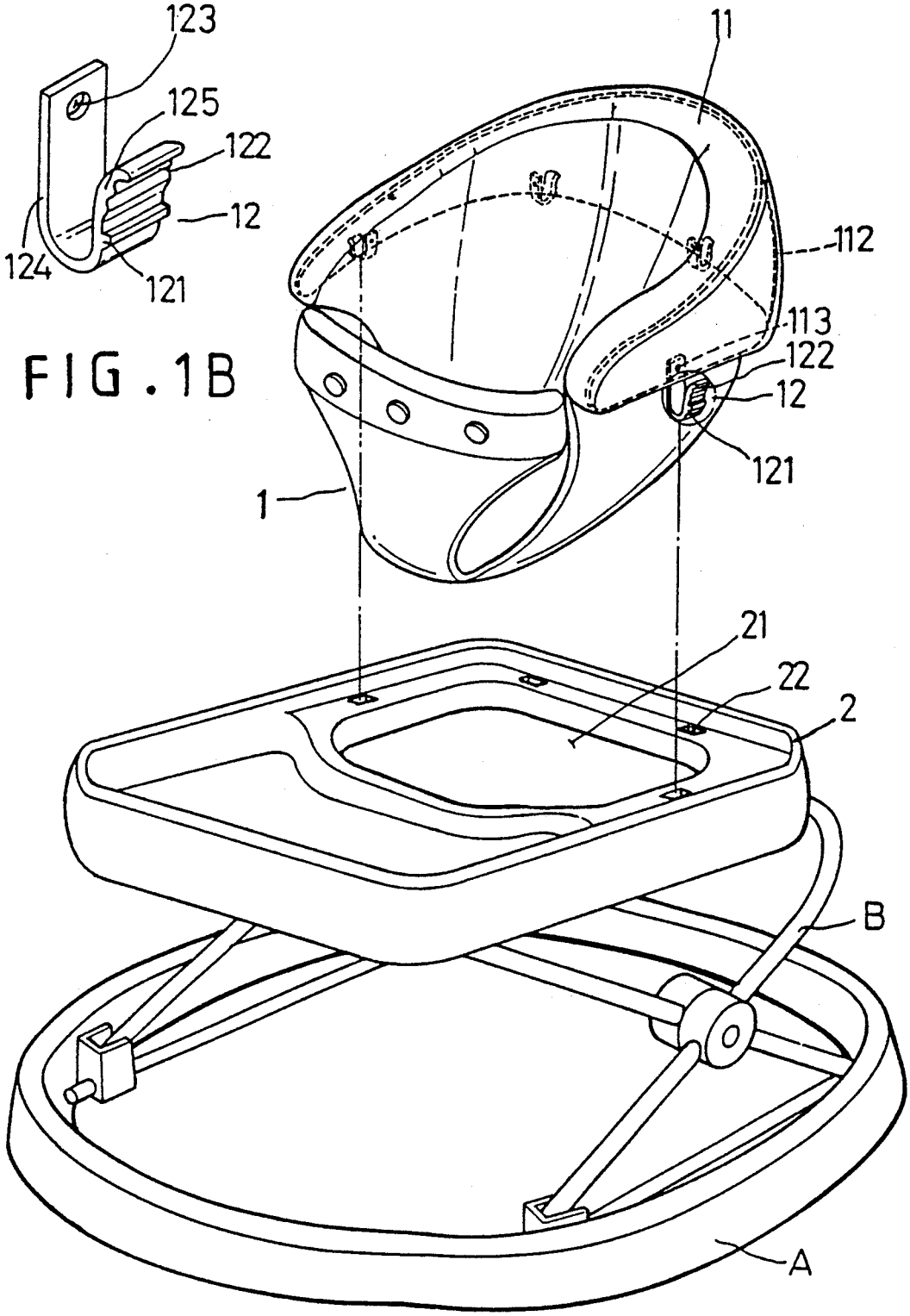
FIG. 1A is an exploded perspective view showing a seat using attachment devices of the present invention for securing the seat to a table of an infant walk support.
FIG. 1B shows the attaching device for securing the seat to a table.

FIG. 1 shows an infant seat 1 to be suspended from a center 21 of a table 2 of an infant walk support by means of a plurality of attachment devices 12. The infant support itself is mostly conventional in construction and is provided with leg adjustment apparatus B between a circular base A and the table 2. The boundary plane of the opening 21 is located within the perimeter of the table 2 which is formed with holes 22 in lateral sides and rear side thereof. The infant seat 1 has a back 11 which extends frontwardly to integrally from arms.

Figure 2:
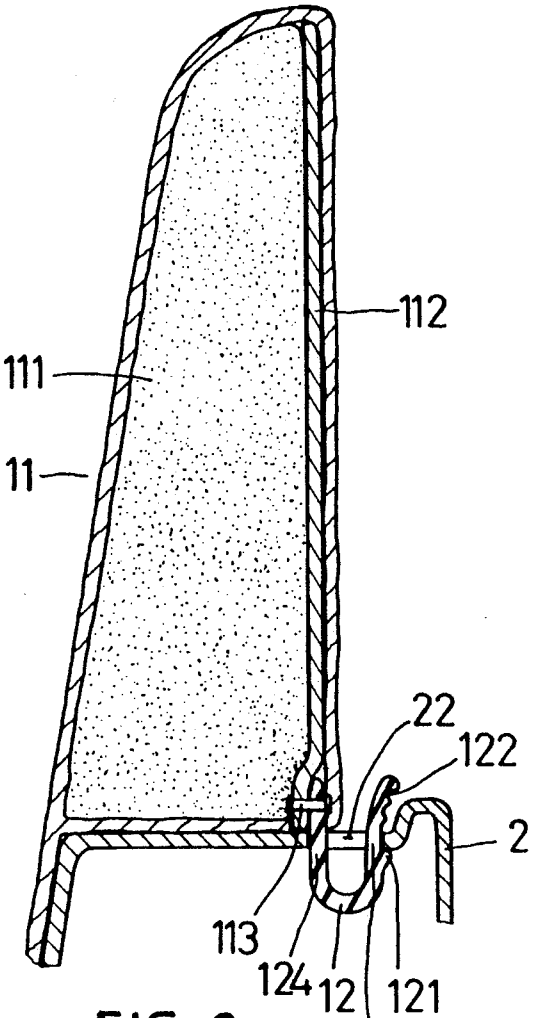
FIG. 2 is a cross-section of a table of an infant walk support on which a back of an infant seat is secured by a securing device.
Figure 4:
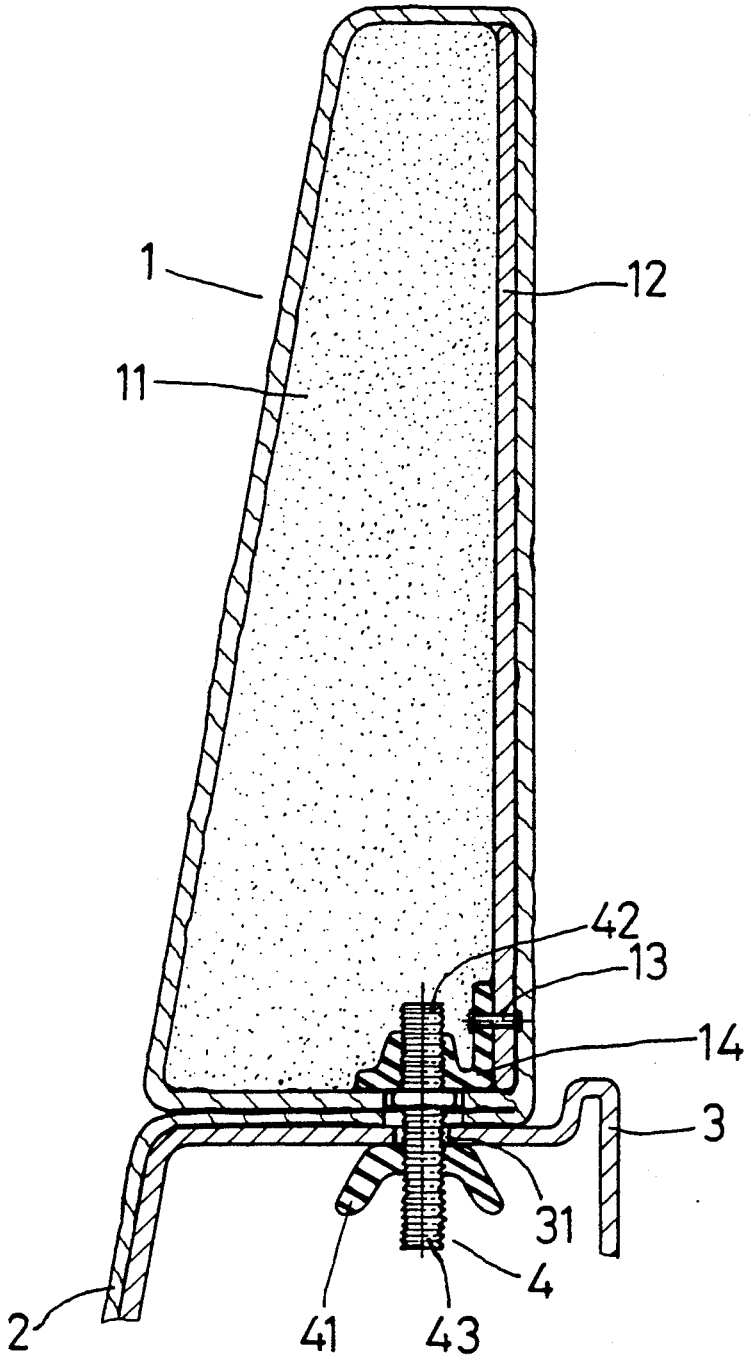
FIG. 4 (PRIOR ART)
FIG. 4 is a cross-section of an infant walk support on which a back of an infant seat is secured by a known attachment device.

Also referring to FIG. 2, the back 11 includes an enclosed skin made of soft material such as leather and stuffed with sponge 111 and a reinforcement plate 112 upraised behind the sponge 111. The securing piece 12 is formed by a bent metal or plastic plate of U section which has a flat part 124 formed with a hole 123 in its upper portion for securing the piece 12 to the reinforcement plate 112 with a rivet 113 and a curved part 125 spaced from the flat part 124 and formed with a free end 122 extending outwardly and an outwardly-directed flange 121 spaced from the free end 122 and forming a stop against which the perforated portion of the table 2 abuts.

To secure the seat 1 to the table 2 of the infant walk support, the back 11 of the infant seat 1 is rested on the perimeter of the table 2 and the securing pieces 12 are fitted into corresponding holes 22. Unwanted removal is prevented by the flanges 121 of the securing pieces 12 which perform a locking engagement to the table 2.

Figure 3:
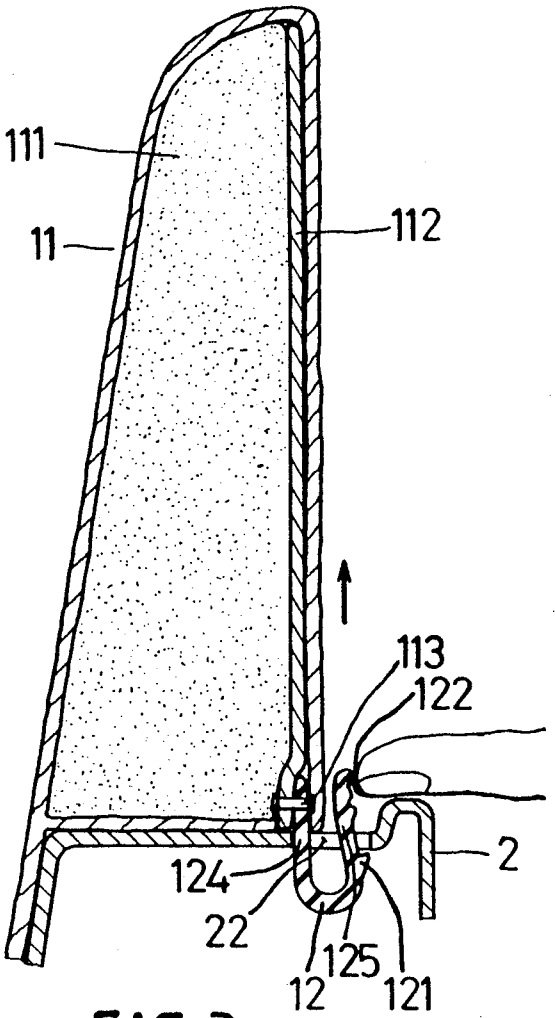
FIG. 3 shows a disassembling operation of the securing device shown in FIG. 2.

In disassembling operation of the infant seat 1, as shown in FIG. 3, the free end 122 of the curved end 125 is pressed inwardly with a finger tip so as to release the locking engagement between the flange 121 and the edge of the hole 22, the seat 1 is able to be removed from the table 2 of the infant walk support.

I claim:

1. An attachment device for releasably securing an infant seat to a table of an infant walk support, comprising:

a frame having a table formed with an opening within a perimeter thereof;

an infant seat adapted to be suspended from the opening of the table; the improvement comprising:

a plurality of perforations formed in the perimeter of the table;

a back member mounted on the infant seat along a back portion and arm portions of the infant seat and adapted to be rested on the perimeter of the table;

a reinforcement plate attached to a rear side wall of the back member from inside thereof;

a plurality of securing pieces adapted to be fitted into corresponding perforations in the perimeter of the table, each having a first leg attaching to the reinforcement plate and a second leg spaced from the first leg and formed with a free end extending outwardly for pressing with a finger tip to move the second leg towards the first leg and a radially extending stop means for engaging an edge of the perforation in the perimeter of the table.

* * * * *